United States Patent [19]

Zavitsanos et al.

[11] 4,076,607

[45] Feb. 28, 1978

[54] PROCESS FOR COAL DESULFURIZATION

[76] Inventors: Peter D. Zavitsanos, 3018 Oak Drive, Norristown, Pa. 19403; Kenneth W. Bleiler, 223 Crestview Road, Hatboro, Pa. 19040

[21] Appl. No.: 642,900

[22] Filed: Dec. 22, 1975

[51] Int. Cl.[2] ..... B10J 1/10; C10L 9/10

[52] U.S. Cl. ..... 204/162 R; 44/1 R; 201/17

[58] Field of Search ..... 44/1 R; 201/17, 19; 204/173, 174, 162 R, 162 S; 423/461

[56] References Cited

U.S. PATENT DOCUMENTS

| | | | |
|---|---|---|---|
| 961,912 | 6/1910 | Tone | 204/173 X |
| 2,983,661 | 5/1961 | Lauer | 204/173 X |
| 3,503,865 | 3/1970 | Stone | 208/10 |
| 3,616,375 | 10/1971 | Inoue | 204/162 R |
| 3,689,233 | 9/1972 | Veloso | 44/10 C |
| 3,843,457 | 10/1974 | Grannen et al. | 201/19 X |

FOREIGN PATENT DOCUMENTS

| | | | |
|---|---|---|---|
| 264 of | 1862 | United Kingdom | 204/174 |

*Primary Examiner*—Carl F. Dees

[57] ABSTRACT

A process for coal desulfurization generates extremely low amounts of heat from microwave energy to induce thermochenical, in-situ, reactions to liberate sulfur in the form of stable gaseous species, such as $H_2S$, COS and $SO_2$.

8 Claims, 1 Drawing Figure

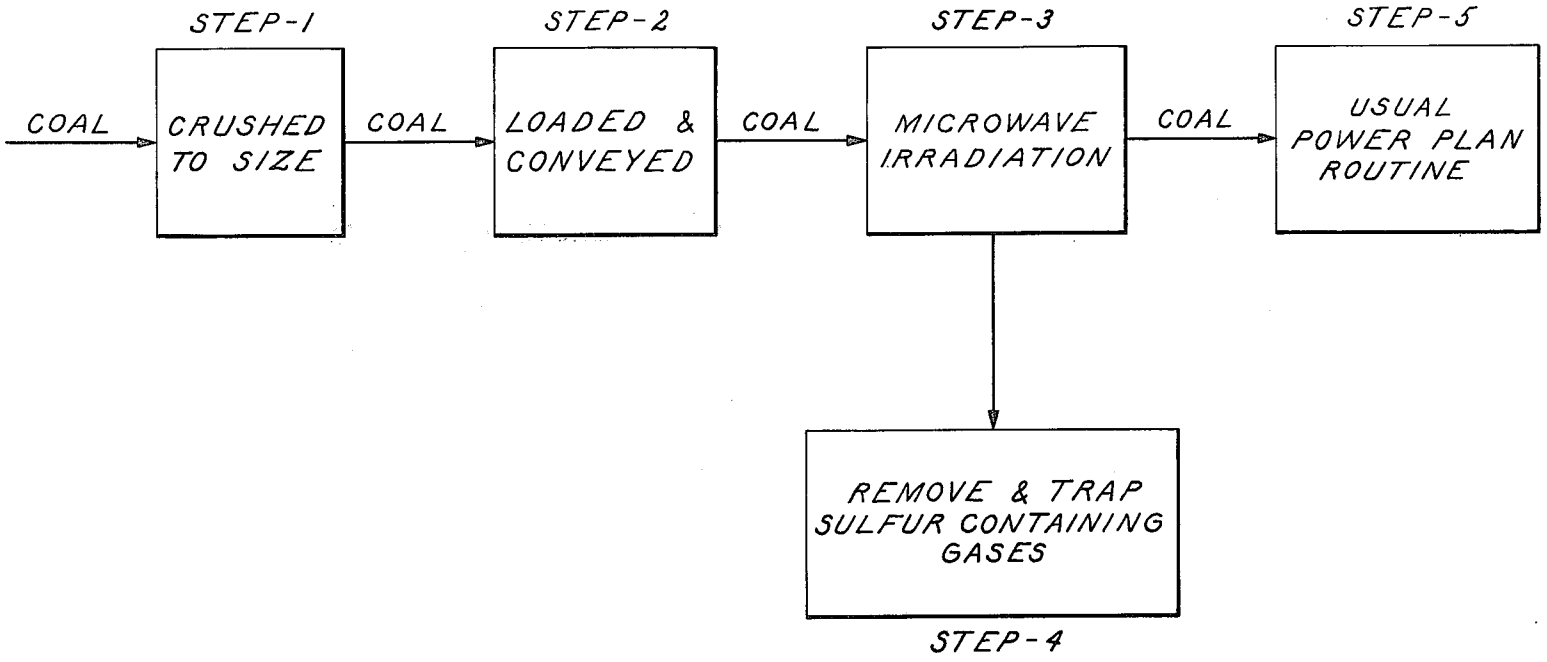
COAL
STEP-1
CRUSHED TO SIZE
COAL
STEP-2
LOADED & CONVEYED
COAL
STEP-3
MICROWAVE IRRADIATION
COAL
STEP-5
USUAL POWER PLAN ROUTINE
STEP-4
REMOVE & TRAP SULFUR CONTAINING GASES

PROCESS FOR COAL DESULFURIZATION

BACKGROUND OF THE INVENTION

1. Field of the Invention

This invention relates to a process for desulfurization of coal, and more particularly relates to desulfurization of coal with extremely low amounts of microwave energy.

2. Description of the Prior Art

A large percentage of available raw coal in the United States contains around 1–5% of sulfur. For most industrial and private uses of coal, sulfur is an element which must be removed in order to utilize raw coal as a fuel for practical and beneficial applications. Desulfurized coal also has beneficial applications in a number of industries where, for example, corrosive combustion products are to be avoided and air pollution is to be minimized.

However, in general, practical method for desulfurization of coal are expensive and are inefficient. For instance, inefficiency results when coal is desulfurized by directly burning the coal in a non-critical area, such as at the mine mouth, in order to meet stringent government regulations concerning air pollution. Coal burned in this manner results in loss of volatiles which have great heating value. On the other hand, burning or heating coal in non-critical areas may result in costly heating and drying apparatus, as coal must be typically heated within temperature ranges of around 600°–800° C to release sulfur. Further, burning coal at the temperature ranges of around 600°–800° C, as in burning at the mine mouth, also results in loss of heating value due to the loss of volatiles.

In consequence of the above, more efficient processes are sought in order to make usable, in a practical sense, vast coal reserves in this country. For instance, prior art methods have suggested the following desulfurization processes: liberating sulfur at relatively low temperatures of about 300°–400° C by utilizing pressurized hydrogen; utilizing super heated steam in a temperature range of 150°–300° C; and utilizing both hot gases and microwave energy to heat coal at temperatures around 600°–800° C. Nevertheless, the above desulfurization processes executed within the stated temperature ranges have not satisfactorily decreased losses in heat value, or in sulfur production associated cost.

In addition to the above, others in the prior art have: generated high temperatures in a range of about 800°–900° C through inductive heating to liberate sulfur; washed coal with carbon disulfide, iron sulfate and chloride, and other organic solvents; scrubbed the combustion gases released by burning coal prior to releasing the combustion gases to the atmosphere; and separated sulfur from coal with magnetic fields. Likewise, these desulfurization processes have not heretofore proven commercially feasible.

For instance, washing coal with carbon disulfide necessitates the use of organic solvents which are expensive. Similarly, the process whereby coal is heated in the temperature range between 800°–900° C, as earlier noted, is costly and results in significant loss of the heating value of the coal. Lastly, liberating sulfur through the magnetic desulfurization process becomes difficult when the magnetic moment, developed by the particles to be separated, is not high enough for magnetic forces to overcome competing hydrodynamic gravitational forces.

Therefore, it is an object of this invention to provide an improved process for desulfurization of coal while still preserving the heating value of coal.

It is another object of this invention to provide an inexpensive yet efficient process for desulfurization of coal.

SUMMARY OF THE INVENTION

A process for coal desulfurization induces thermo-chemical, insitu, reactions between sulfur and other elements in the coal. Coal is pulverized to an approximate average diameter size within a range of about less than a centimeter to 4 centimeters. Next, the coal is irradiated with microwave energy of about 500 watts or higher at a frequency of about 2.45 Ghz or higher for about 20–60 seconds at an air pressure in a range between one atmosphere to less than one atmosphere. An extremely low amount of thermal energy, equivalent to about 0.3–1% of the heated value of coal heretofore required to rearrange chemical bonds uniting sulfur and other compounds of the coal, is generated by the microwave energy. This low thermal energy acts to rearrange the chemical bonds between sulfur and other elements contained therein without significantly heating the coal itself. Sulfur is liberated upon forming one or more stable gaseous compounds, such as hydrogen sulfide, sulfur dioxide, or sulfur carbonyl. The gaseous products are easily removed by conventional techniques.

BRIEF DESCRIPTION OF THE INVENTION

FIG. 1 shows a block diagram for a process for coal desulfurization.

DETAILED DESCRIPTION OF THE INVENTION

Our novel process for desulfurization of carbonaceous aggregates, such as coal, employs extremely low amounts of thermal energy, derived from the heat effects of thermo-chemical in-situ reactions between organic or pyritic sulfur and other elements of compounds, such as hydrogen, oxygen, carbon dioxide and water present in the coal. The in-situ reactions (that is, a reaction within the carbonaceous aggregates among some of the constituent elements), illustrated below, allow sulfur to be liberated upon the forming of hydrogen sulfide, sulfur dioxide, or sulfur carbonyl.

$$\text{S (bound)} + H_2O\text{ (absorbed)} + \Delta H \rightarrow H_2S\text{ (gas)}$$

$$\text{S (bound)} + H_2\text{ (bound)} + \Delta H \rightarrow H_2S\text{ (gas)}$$

$$\text{S (bound)} + O_2\text{ (bound)} + \Delta H \rightarrow SO_2\text{ (Gas)}$$

$$\text{S (bound)} + CO_2\text{ (bound or gas)} + \Delta H \rightarrow \text{OCS (gas)}$$

Bound in the above reactions means sulfur bound to iron (as in a pyrite) or sulfur organically bound to carbon (as in a dibenzothiophene). $\Delta H$ is defined as a small amount of energy, in the form of activation energy, required to induce sulfur gasification. Thus, as illustrated above, the in-situ reactions allow for sulfur to be liberated without a transference of reactant elements to the carbonaceous aggregates.

Normally, high thermal energy in a range of about 600°–900° C is required to break bonded constituents of the coal (i.e., Fe-S and C-S). However, our new inventive processes utilizes electromagnetic energy and and accompanying reaction chamber, such as an oven, to deposit microwave energy to sulfur bearing areas or compounds to effect volatilization of sulfur in a form of one of the sulfur's stable gaseous compounds. More specifically, microwave thermal energy is deposited in a manner to selectively heat compounds in coal that contain large amounts of highly reactive sulfur, for instance, pyrites, pyritotites and thiophenes. Heating the preceding compounds induces thermo-chemical, in-situ, reactions between the preceding compounds and other neighboring reactive compounds, namely, $H_2O$, $CO_2$ or bound hydrogen. Further, while the bonds of sulfur-iron and sulfur-carbon are broken, in response to the effects of the microwave initiated in-situ reactions, sulfur is released and united to gaseous, reaction elements through molecular bonding.

The frequency of the microwave energy, necessary to cause the sulfur to react with gaseous elements present in the coal, is of an order of about 2.4–10 Ghz, while the microwave energy is in a range between 500 and 1000 watts. Coal at the above frequencies and watt energy is irradiated with microwave energy for a duration of about 40–60 seconds at approximately one atmosphere or less.

Moreover, the heating energy generated by the microwave energy per gram that is required to induce the in-situ reaction is about 3 calories/gram; this is to be compared with 200 calories/gram required to heat coal to around 800° C required for thermal removal of the sulfur. Since the heating value of coal is 10,000–14,000 BTU/lb. or 5,000 calories/gram, this translated into electrical energy is about 1,500 calories/gram. Hence, by utilizing microwave heat energy, only 0.3–1% of the heating value of coal is necessary in order to induce an in-situ reaction which favors the volatilization of sulfur in the form of a stable gaseous compound. Additionally, during the reaction, the temperature of the coal rises to a modest level of between 50°–150° C with no significant evolution of hydrogen or carbon containing matter, which evolution would result in loss of heating value.

INTRODUCTION TO DATA

Depending on the time duration, particle size, type of sulfur, and origin of coal, around 50% of all the sulfur is liberated. Table 1, which follows, shows the effect of desulfurization with microwave energy on bituminous coal containing both organic and pyritic sulfur, under the conditions illustrated below:

| | |
|---|---|
| Microwave frequency: | 2.45 Ghz |
| Sample weight: | 10 grams |
| Sample geometry: | chunks |
| Radiation time: | 20–60 seconds |
| Water content: | 1% |
| Bed thickness: | 1.5 – 2 cm |
| Particle size: | 0.1 – 4 cm |
| Total Sulfur Content: (in weight percent) | 4.1 |
| % of Sulfur removed: | 26.8 – 53.5 |

TABLE I

COAL DESULFURIZATION DATA

| Sulfur Content in Wt.% | | | |
|---|---|---|---|
| Before Treatment | After Treatment | Nature of Treatment | Sulfur Removed in Wt.% |
| 3.94 | | | |
| 3.88 | | | |
| 4.10 | | | |
| 4.45 | | | |
| 4.20 | | | |

TABLE I-continued

COAL DESULFURIZATION DATA

| Sulfur Content in Wt.% | | | |
|---|---|---|---|
| Before Treatment | After Treatment | Nature of Treatment | Sulfur Removed in Wt.% |
| (4.11 Ave.) | | | |
| | 2.85 | | |
| | 2.49 | 20 sec. in | |
| | 2.48 | 1 Atm Air, | |
| | (2.61 Ave.) | Glass Container | 36.5 |
| | 2.53 | 60 sec. in | |
| | 2.18 | 1 Atm Air, | |
| | 2.56 | Glass Container | 41.1 |
| | (2.42 Ave.) | | |
| | 2.50 | 20 sec. in | |
| | 2.67 | 1 Atm Air | |
| | (2.59 Ave.) | No Container | 36.9 |
| | 2.84 | Same as Above | |
| | 2.93 | | |
| | 3.03 | | 28.7 |
| | (2.93 Ave.) | | |
| | 2.77 | 40 sec. in | |
| | 2.43 | 1 Atm Air | |
| | (2.60 Ave.) | No Container | 36.7 |
| | 1.97 | 40 sec. in | |
| | 1.84 | Reduced Air | |
| | (1.91 Ave.) | Pressure (1–5 mm Hg) | 53.5 |
| | 2.38 | 60 sec. in | |
| | 2.51 | Reduced Air | |
| | (2.45 Ave.) | Pressure (1–5 mm Hg.) | 40.4 |

Desulfurization of coal, in accordance with out invention, is preferably practiced in a batch process but, however, is not limited to a batch process. For persons skilled in the art, may easily convert a batch process to a continuous process or other convention type processes for desulfurization of various quantities of coal.

In the batch process, as illustrated at step 1 of FIG. 1, coal is crushed to size, which size is usually between 0.1 to 5 centimeters. Step 2 shows that the crushed coal is transported to a microwave cavity or reactor by a suitable conveyor. Coal is loaded on the conveyer in a bed thickness or heights of around 1 to several centimeters. At step 3, the microwave rector receives the crushed coal, and subjects the coal to irradiation with mocrowave energy. The input frequency of the microwave energy is selectively tuned to a particular coupling frequency associated with the sulfur compound in the coal material, and thereby causes the sulfur to react with gaseous elements present in the coal.

Parenthetically, suitable input frequencies are of an order of about 2.4 – 10 GHZ. The microwave energy is in a range between 500 to 1000 watts and the coal is irradiated with microwave energy for a duration of about 40–60 seconds at approximately 1 atmosphere of air or less.

At step 4, the resulting or reaction sulfur containing gaseous compounds, namely $H_2S$, $SO_2$ and OCS are by volume separated, trapped and removed by pumping or forcing the separated volumes into individual compartments. In the compartments, the separated volumes are converted to elemental sulfur or set up for disposal. $H_2S$, for example, may be converted to elemental sulfur by providing a reaction with sulfur dioxide. Finally, at step 5, the coal subsequent to treatment with microwave energy, is removed for further processing. For instance, the coal may be further processed or pulverized to a finely divided form with conventional power plant equipment. Or, as another example, the coal may be further burned and/or crushed as required by normal plant procedures to effect a special application for the coal.

It will be obvious that within the scope of our process for desulfuirzation of coal many modifications are possible without departing from the inventive concepts disclosed herein, and that all matter contained in the above description and the accompanying drawing should be interpreted as illustrative and not in a limiting sense.

What I claim as new and desire to secure by a Letters Patent of the U.S. is:

1. A process for desulfurization of carbonaceous aggregates containing a relatively high percentage of sulfur, which comprises:
   (a) crushing said aggregates to an average particle diameter of a size of about less than 5 centimeters;
   (b) irradiating said aggregates with electromagnetic microwave energy for a duration to obtain an average temperature of said aggregates of no more than 150° C to induce chemical reactions to break bonds uniting gaseous elements and sulfur contained in said aggregates;
   (c) liberating said sulfur from said aggregate upon forming gaseous compounds.

2. A process for desulfurization of carbonaceous aggregates as recited in claim 1, further comprising:
   (a) selectively tuning input frequency of said electromagnetic energy to an optimum coupling frequency associated with sulfur containing compounds in a particular one of said aggregates.

3. A process for desulfurization of carbonaceous aggregates as recited in claim 1 wherein said aggregate is coal.

4. A proces for desulfurization of carbonaceous aggregates as recited in claim 3 wherein said gaseous compounds are hydrogen sulfide, sulfur dioxide and carbon oxysulfide.

5. A process for desulfurization of carbonaceous aggregates as recited in calim 4 further comprising:
   (a) generating thermal energy from said microwave energy to desulfurize coal at a rate of about 0.3 – 1% of a heating value of said coal, wherein said generated energy liberates said sulfur with little loss of said heating value of said coal.

6. A process for desulfurization of carbonaceous aggregates as recited in claim 5 wherein said heating energy is about 3 calories per gram.

7. A process for desulfurization of carbonaceous aggregates as recited in claim 6 wherein said electromagnetic energy is about 1000 watts at a frequency of about 2.45 – 10 GHZ per second.

8. A process for desulfurization of carbonaceous aggregates as recited in claim 4 further comprising:
   (a) transporting said coal to a reaction chamber in a bed of about one to several centimeters in thickness;
   (b) separating said hydrogen sulfur, sulfur dioxide and carbon oxysulfide for subsequent trapping and converting to elemental sulfur.

* * * * *